US007594381B1

(12) United States Patent
Greenberg

(10) Patent No.: US 7,594,381 B1
(45) Date of Patent: Sep. 29, 2009

(54) SEWING THREAD

(75) Inventor: N. Geoffrey Greenberg, Denver, NC (US)

(73) Assignee: American & Efird, Inc., Mount Holly, NC (US)

( * ) Notice: Subject to any disclaimer, the term of this patent is extended or adjusted under 35 U.S.C. 154(b) by 1072 days.

(21) Appl. No.: 10/759,586

(22) Filed: Jan. 15, 2004

(51) Int. Cl.
*D02G 3/22* (2006.01)

(52) U.S. Cl. ..... 57/237

(58) Field of Classification Search ..... 57/236–238, 57/252, 255, 256
See application file for complete search history.

(56) References Cited

U.S. PATENT DOCUMENTS

2003/0226347 A1* 12/2003 Smith et al. ..... 57/210
2004/0131821 A1* 7/2004 Mandawewala ..... 428/97

OTHER PUBLICATIONS

Kathryn L Hatch, Textile Science, 1993 West Publishing Company, 1st edition, p. 294.*

* cited by examiner

*Primary Examiner*—Shaun R Hurley
(74) *Attorney, Agent, or Firm*—K&L Gates LLP

(57) ABSTRACT

An improved sewing thread and method of making it where at least one strand of spun yarn is composed of 100% staple fibers and has a high level of single twist that is equal to or greater than 4 more turns per inch than that of the ply twisted final product.

14 Claims, 2 Drawing Sheets

SEWING THREAD

FIELD OF INVENTION

This invention relates to an improved sewing thread composition and method of manufacturing same. In particular, my new sewing thread is characterized by a high degree of twist that is imparted to each of the individual spun yarn strands compared to the degree of opposite twist imparted to the final ply twisted composite.

BACKGROUND OF THE INVENTION

Various types of sewing threads and the methods of making them are well known in the art. Typically, sewing threads fall into four types; (1) spun threads, (2) core threads, (3) continuous filament threads, and (4) air entangled threads. My invention relates primarily to the first type, spun threads. In general, all sewing threads are formed from a combination of individual yarns and these yarns are manufactured in differing ways and composed of differing materials. Spun threads are characterized in that the individual yarns or singles are fabricated from small pieces of staple through a drafting and twisting process commonly known as spinning. The staple fiber is typically composed of natural fibers or small pieces of synthetic filaments less than 2 inches in length, however, when aramid and/or meta-aramid fibers are used those fibers may exceed 2 inches in average length.

Conventional spun threads are commercially manufactured in a series of process steps which begins by spinning bulk staple fibers into multiple small spinning bobbins of spun yarn. The staple fiber can be synthetic, natural or a mixture of each. The spinning step, typically ring spinning, not only takes the small pieces of staple fibers and creates a continuous spun yarn or single, but also imparts a quantifiable amount of twist in the singles, which is measured in turns per inch. These multiple small bobbins of singles are then used in a single end winding process where the individual singles are joined together end to end to make larger bobbins of continuous spun yarn. The single end winding process also typically employs "yarn clearers" that remove imperfections in the singles, which are commonly referred to as "slubs" or "fly." Then, two or more of the spun yarns are combined together in a doubling process to make a unitary composite of spun yarn, where each individual spun yarn has the same amount of twist, all in the same direction. The direction of this twist is typically referred to as the S direction. The unitary composite of two or more singles is then twisted in the opposite direction (the Z direction) to a level of twist that is typically less than 3 turns per inch when compared to the twist of the individual spun yarns or singles. At this point the sewing thread can be further processed or "finished." Finishing can be a single step or multiple steps and can include lubricating, heat setting, coating, dying or other commonly known finishing steps to enhance thread performance.

In contrast to spun threads, both core threads (also known as "core spun threads"), continuous filaments, and air entangled threads each contain at least one continuous filament or bundle of filaments of synthetic material, typically acrylic, nylon, polyester, polyethylene, or mixtures thereof. In core threads, staple is spun over and around the continuous filaments or bundle of filaments to form a "core spun yarn." Two or more of these core spun yarns are plied together and twisted to form the core spun sewing thread. The "core" of continuous filament(s) gives the finished sewing thread high strength and durability. In some cases, a natural staple, such as cotton, may be spun around the continuous synthetic filament(s). The air entangled sewing thread is somewhat similar to the core thread in that it contains yarns that are made of continuous synthetic filaments. An air jet is used to disrupt the bundle of continuous filaments in an overfed yarn which causes it to entangle with one or more of the other continuous filaments to produce a textured final thread product. The common element of both air entangled and core threads is the use of continuous filaments of synthetic polymer material. Spun threads on the other hand contain no continuous filaments. When threads containing continuous filaments are compared to spun threads in sewing applications that require multi-directional sewing, those threads containing the continuous filaments generally have less breakage than that of spun threads. Less breakage translates into less operator and/or machine downtime which directly translate into a cost saving for each manufactured piece. In addition, threads containing continuous filaments generally withstand or hold-up better than spun threads when the sewn into garments that are subjected to abrasive treatments, such as stone washing of fabrics like denim.

One advantage of spun threads over core or entangled sewing threads, from a manufacturing or raw material cost point of view, is that spun threads are the least expensive of the three types of threads to manufacture because the cost of staple fiber is much less expensive than that of continuous filaments. However, from a performance point of view, i.e., sewability and durability, spun threads are less desirable than threads containing continuous core filaments. The differences are more evident during heaving sewing applications and/or when the thread undergoes abrasive treatment such as occurs in the commercial stone washing of denim jeans. In these environments, spun thread has a tendency to fray or break and generally does not perform as well as threads where the individual yarns or singles contain a continuous filament core. Accordingly, there exists a need to develop an improved spun thread that contains the less expensive staple but exhibits performance greater than conventional spun thread and more preferably approaches or equals that of core thread. I have now determined that by imparting a high twist to the individual spun yarns, which is contrary to established manufacturing doctrine, that I can produce a ply twisted composite thread having two or more yarns, where at least one single composed of 100% staple fiber. Such an improved spun thread exhibits performance almost equal to that of a conventional core type sewing thread.

Accordingly, it is an object of my invention to provide a sewing thread comprising staple fiber that has superior performance when compared to conventional spun thread made from 100% spun staple.

It is a further object of my invention to provide a sewing thread made from staple fiber that exhibits performance and durability approaching or equaling that of conventional core threads.

Yet a further object of my invention involves a method of manufacture that will produce the improved spun sewing thread of my invention. These and other objects and embodiments will become evident from the following description of my invention and the appended claims that define my inventions.

DRAWING

SUMMARY OF THE INVENTION

Figure 1:
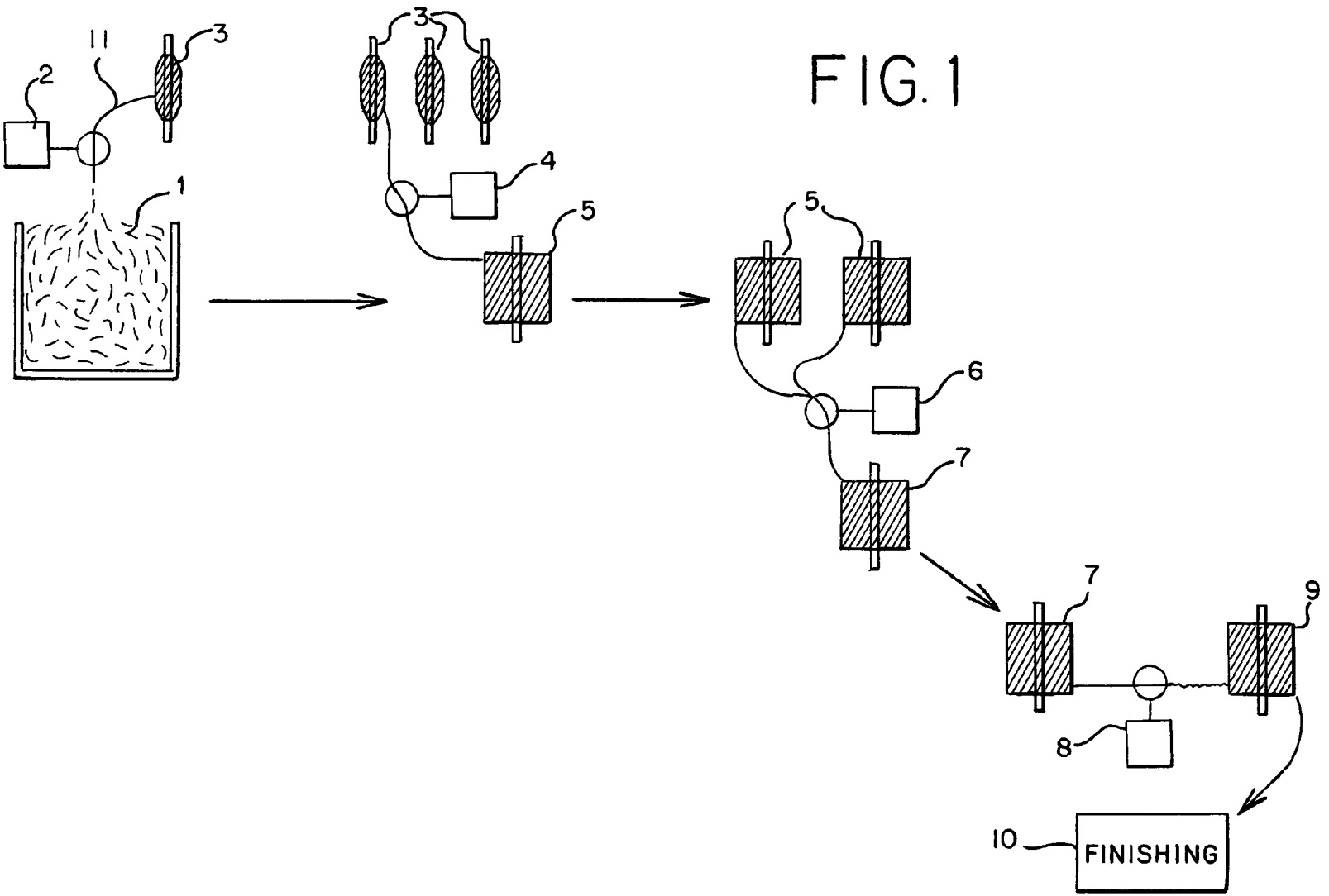
FIG. 1 is a schematic representation of a method of making the improved spun thread of my invention.

I developed my invention to overcome the shortcomings of conventional spun sewing threads that is well known to those in the art of manufacturing, selling and, more importantly, using such sewing threads. "Sewing threads" generally have two or more strand of yarn plied together and twisted to form a unified composite. As used in this application the term "yarn" means any material having at least one strand containing either staple fibers, continuous filament(s) or a combination of both. "Spun yarn" means at least one continuous strand or single of assembled staple fibers that have been drafted and twisted by a spinning frame. Such a spinning process is typically referred to as "ring spinning." In addition to forming a continuous strand out of the small pieces of staple fibers, ring spinning imparts a quantifiable amount of twist imparted to the resultant single as a result of the staple being spun. I have now unexpectedly found that if the process of spinning the staple fibers is modified, then the final resulting thread product will perform significantly better than conventional spun thread. This modification involves imparting a greater degree of single twist in the singles than has ever been done before in the art. Imparting a high degree of twist to the singles goes against conventional thinking and practice because excessive twist can result in a lower tensile strength of the single. Accordingly, those skilled in the art would not impart the level of twist found in the singles of my invention. My improved spun thread comprises a sewing thread comprising, in having at least one spun yarn ply twisted together with a second yarn in a first direction about each other along a common axis to form a ply twisted composite yarn, where the spun yarn contains 100% staple fibers, has a greater degree of twist than the plied twisted composite yarn, and is twisted in the opposite direction of the ply twisted composite yarn. In particular, my invention uses at least one spun yarn having a single twist of at least 4 turns per inch more than that of the plied composite, which is twisted in the opposite direction, and more preferably, at least 6 turns per inch more than the plied composite.

The staple fiber used in my improved thread can be selected from the group consisting of acrylic, polyester, rayon, polyethylene, polypropylene, nylon, wool, cotton, aramid, meta-aramid, and mixtures of these materials. Aramid and meta-aramid fibers are defined as man-made fibers where the fiber-making material is a long chain synthetic polyamide having at least 85% of its amide linkages attached directly to two aromatic rings. Examples of aramid fibers include Nomex® and Keylar®. A preferred staple fiber is a synthetic polymer, most preferably polyester. At least one yarn of my sewing thread must be composed of 100% staple fibers and the preferred staple fiber is one where the average length of the fibers is less than 3 inches, most preferably less than 2 inches in average length. Likewise, it is preferable to use staple fibers that are less than about 2.0 denier/filament, most preferably less than about 1.5 denier/filament. Another benefit of my invention is that the finished thread is more pleasing to the eye and exhibits a higher sheen compared to a conventional spun thread and also exhibits a tighter less fuzzy looking appearance than conventional spun thread.

My invention also covers an improved method of manufacturing a sewing thread comprising providing a sufficient quantity of bulk staple fiber; ring spinning the staple fiber to form multiple spinning bobbins of continuous spun yarn, where the ring spinning imparts a first twist to the spun yarn; combining the twisted spun yarns from individual spinning bobbins end to end in a single end winding process to form bobbins of continuous single spun yarn while substantially maintaining the first twist in the spun yarns; combining at least one of the twisted spun yarns from the bobbins formed in the previous step with a second yarn to form a unitary combination of yarns; and ply twisting the unitary combination of yarns to achieve a second twist that is less than the first twist and in a twist direction opposite that of the individual twisted spun yarns to form a ply twisted composite yarn.

DETAILED DESCRIPTION OF PREFERRED EMBODIMENTS

Reference will be made to FIG. 1 which shows a method of manufacturing the improved thread of my invention. Staple fiber 1 in bulk quantity is withdrawn or drafted from a holding/storage container and is subjected to well-known conventional processes, including "opening," "carding," "breaker drawing," "finishing drawing," and "removing," a spinning frame machine is used to complete spinning process 2, which preferably involves the use of a ring spinning process to form continuous strands of spun yarn 11 known as singles that are collected (taken up) on small spinning bobbins 3. Typically, there will be multiple spinning processes operating simultaneously to continuously form multiple spinning bobbins 3. Spinning process 2 is manipulated and adjusted so that spun yarn 11 has imparted to it a high degree of twist, typically in the S direction. The spinning process is manipulated by changing the ratio of yarn delivered by the nip rolls, measured in inches per minute, to the rpm of the spinning bobbin, such that the resultant spun yarn has increased turns per inch as compared to conventionally spun yarn. This can be accomplished by changing the delivery speed of the yarn, the rpm of the spinning bobbin or a combination of these two. By high degree of twist I mean more than is imparted to singles from known processes that involve spinning of staple fibers. More preferably, a high level of twist means having at least 3 or more turns per inch as compared to the final sewing thread composite that is ply twisted in Z direction, opposite to that of the individual spun yarns which make up the final sewing thread product. More preferably, the spun yarn or singles of my invention have imparted to them at least 4 or more turns per inch as compared to the ply twisted final sewing thread product.

Multiple spinning bobbins 3 are used in a single end winding step 4 where the spun yarn ends of each spinning bobbins 3 are joined together to form one long continuous spun yarn that is taken up on spool 5. Single end winding (otherwise known as "winding") is well known to those skilled in the art and does not warrant a detailed description. Any single end winding step will work to manufacture the thread of my invention, provided the high degree of twist of the singles are maintained. The spun yarn on spools 5 are then used in a doubling process 6 to form a single spool 7 of parallel spun yarns. Doubling is well known to the art and essentially involves combining two or more strands in parallel prior to a twisting step in the Z direction. The number of spools 5 used simultaneously in doubling process 6 is dependent on what the desired number of plies is in the final sewing thread product. Like single end winding, any doubling process can be used in my invention that is known to the art, again provided the high level of twist of the singles is substantially maintained. Also, it is not critical to my invention that only spun yarn is used in the doubling process, however, at least one spun yarn must be used. This means that, for example, two spools of spun yarn may be doubled with a spool of core spun yarn or other continuous filament containing yarn. For the purposes of further describing the process of my invention I will describe the final thread product as having at least two spun yarns. In both the single end winding step and the doubling step the high degree of twist imparted to the spun yarn is substantially maintained. It is also important that each spun yarn is twisted in the same direction, typically the S direction.

After the doubling step, spool 7 containing the parallel spun yarn strands is subjected to a ply twisting process 8 where the parallel strands are twisted in the opposite direction of the twist of the individual strands, i.e. in the Z direction. Again, the particular ply twisting process chosen is not critical to my invention and any known process can be used. The level of twist imparted to the strands of spool 7 is at least 3, more preferably 4, less than the number of turns per inch of the individual spun yarn strands. For example, if the individual spun yarn or singles have a level of twist equal to 9 turns per inch in the S direction, ply twisting step 8 will impart twist in the Z direction of no more than 5 turns per inch. The Z direction being in the opposite direction of that of the individual spun yarns. After ply twisting, the resulting multi-ply thread is taken up on spool 9. At this point the thread can be used as sewing thread as is or subjected to one or more finishing steps 10. Finishing would include lubricating, coating, heat treating, dying or any other process or treatment steps customary and known to the thread making industry.

Although I have described my invention with respect to preferred embodiments, it is to be also understood that it is not to be so limited since changes and modifications can be made therein which are within the full scope of my invention as detailed by the claims that are attached to the end of this application.

To further explain my invention I have included examples comparing the performance of the sewing thread of my invention with that of both conventional spun threads and conventional core spun threads.

EXAMPLE

Several samples of my invention were prepared using the process described above with each sample of sewing thread having two plies of 100% spun yarn made from polyester staple fiber, each ply having a 12/1 cotton count. The length and denier of the polyester staple was 1.75 inches and 1.2 den/fil. Each sample was prepared using singles having the same level of twist, but where each sample was made using singles that had higher and higher twist levels compared to the previous sample. In other words, for Sample A (shown in the graph below) 17 turns per inch were imparted to each single or spun yarn before the doubled yarn is ply twisted to make the final thread composite. The second sample, Sample B, was made using spun yarns that had 18 turns per inch before ply twisting. In each sample the subsequent ply twisting step imparted 12 turns per inch in the opposite or Z direction compared to the plied composite of individual singles.

For comparison purposes, two existing and commercially available sewing threads were also tested. Both are available from American & Efird and sold under the brand names Perma Core TEX 105 and Perma Spun TEX 105. "TEX" is a unit for expressing linear density, equal to the weight in grams of 1 kilometer of yarn, filament, fiber or other textile strand. Perma Core is a core spun sewing thread having two core spun strands each containing a core of continuous polyester filaments with polyester staple fiber wrap around the core. Each strand was twisted in the S direction 13.1 turns per inch. The Perma Spun is a conventional spun polyester sewing thread comprising three strands of spun yarn made from 100% polyester staple. Each strand was twisted in the S direction 13.5 turns per inch. Both the Perma Core and Perma Spun were ply twisted in the Z direction 12.2 and 10.74 turns per inch, respectively.

Figure 2:
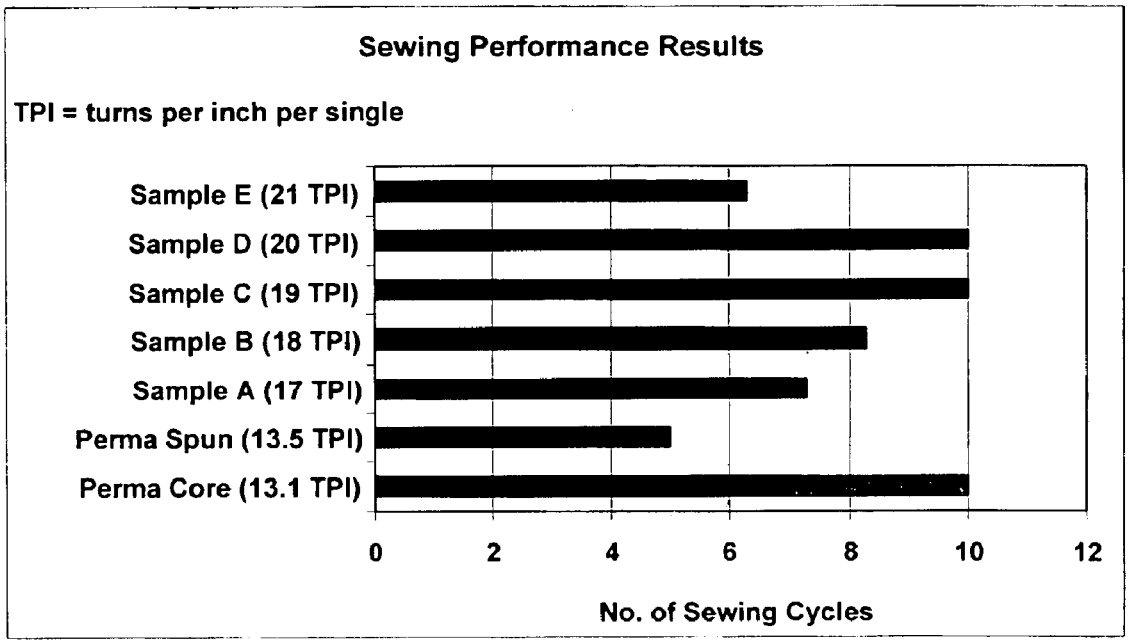
FIG. 2 is a graph of sewing performance results.

The test procedure evaluated each thread sample using only the left hand needle of a conventional industrial sewing machine (Brother LT-2 B842-405—Double Needle Lockstitch) to sew a predefined "sewing cycle" of 10 inches in the forward direction and 6 inches in the reverse direction using a 60 inch belt of 4 ply 420 denier Nylon Air Bag fabric. The sewing machine was set at a tension of 350 grams, a speed of 4200 RPM and 7 stitches per inch. A given test of a thread sample would end upon breakage of the thread. Each thread sample was evaluated three times to determine an average number of completed sewing cycles. The number of completed sewing cycles is plotted on the graph of FIG. 2 below:

As the graph of FIG. 2 indicates, the higher the twist of the individual spun yarns (i.e. singles) the better performance, until a maximum is reached and then the performance drops off. As shown above, Samples C & D match the performance of Perma Core and greatly exceed conventional spun thread (i.e. Perma Spun), which only averaged 5 sewing cycles.

I claim:

1. A 2-ply sewing thread comprising, in combination, at least one spun yarn ply twisted together with a second yarn in a first direction about each other along a common axis to form a ply twisted composite yarn, where the spun yarn contains 100% staple fibers, has a single twist equal to or greater than 4 more turns per inch than that of the plied twisted composite yarn, and is twisted in the opposite direction of the ply twisted composite yarn.

2. The sewing thread of claim 1 further characterized in that each spun yarn has a twist that is equal to or greater than 6 more turns per inch than that of the ply twisted composite yarn.

3. The sewing thread of claim 1 further characterized in that the second yarn is a spun yarn.

4. The sewing thread of claim 1 further characterized in that at least a portion of the staple fiber is a synthetic material.

5. The sewing thread of claim 1 further characterized in that the staple fiber is composed of one or more synthetic polymers.

6. The sewing thread of claim 1 further characterized in that the staple fiber is selected from the group consisting of wool, cotton, nylon, polyester, rayon, polyethylene, polypropylene, aramid, meta-aramid and mixtures thereof.

7. The sewing thread of claim 1 further characterized in that the staple fiber is polyester.

8. The sewing thread of claim 1 further characterized in that the staple fiber is composed of staple that averages less than about 2 inches in length.

9. The sewing thread of claim 1 further characterized in that the staple fiber is composed of staple less than about 1.5 denier/filament.

10. The sewing thread of claim 1 further characterized in that the ply twisted composite yarn has a twist equal to at no more than 4 turns per inch less than the twist of the individual spun yarns.

11. The sewing thread of claim 1 where the individual spun yarns, prior to being plied, have a tensile strength that is less than the tensile strength of the ply twisted composite yarn.

12. A 2-ply sewing thread comprising, in combination, at least one spun yarn ply twisted together with a second yarn in a first direction about each other along a common axis to form a ply twisted composite yarn, where the spun yarn contains 100% staple fibers, has a single twist equal to or greater than 17 turns per inch, is twisted in the opposite direction of the ply twisted composite yarn, and has a TEX equal to about 105, where the twist of the ply twisted composite is not greater than 13 turns per inch.

13. A 2-ply sewing thread comprising, in combination, at least one spun yarn ply twisted together with a second yarn in a first direction about each other along a common axis to form a ply twisted composite yarn, where the spun yarn contains 100% staple fibers, has a single twist between 17 turns per inch and 20 turns per inch, is twisted in the opposite direction of the ply twisted composite yarn, and has a TEX equal to about 105, where the twist of the ply twisted composite is not greater than 13 turns per inch.

14. A 2-ply sewing thread comprising, in combination, two spun yarns ply twisted together in a first direction about each other along a common axis to form a ply twisted composite yarn, where the spun yarns contains 100% staple fibers, each having a single twist between 17 turns per inch and 20 turns per inch, is twisted in the opposite direction of the ply twisted composite yarn, and has a TEX equal to about 105, where the twist of the ply twisted composite is not greater than 13 turns per inch.

* * * * *